US010392887B2

(12) United States Patent
Hall et al.

(10) Patent No.: US 10,392,887 B2
(45) Date of Patent: Aug. 27, 2019

(54) DOWNHOLE PAYLOAD RELEASE CONTAINERS, METHOD AND SYSTEM OF USING THE SAME

(71) Applicant: HALLIBURTON ENERGY SERVICES, INC., Houston, TX (US)

(72) Inventors: Lee J. Hall, The Woodlands, TX (US); Sandip Agarwal, Arlington, MA (US); Brian Mayers, Arlington, MA (US); Olivier Schueller, Arlington, MA (US); Hootan Farhat, Somerville, MA (US); Philip Graf, Chestnut Hill, MA (US); Joseph McLellan, Quincy, MA (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 0 days.

(21) Appl. No.: 15/305,008

(22) PCT Filed: Nov. 4, 2015

(86) PCT No.: PCT/US2015/059029

§ 371 (c)(1),
(2) Date: Oct. 18, 2016

(87) PCT Pub. No.: WO2017/078699

PCT Pub. Date: May 11, 2017

(65) Prior Publication Data

US 2017/0259977 A1 Sep. 14, 2017

(51) Int. Cl.
*E21B 27/00* (2006.01)
*B65D 75/36* (2006.01)
(Continued)

(52) U.S. Cl.
CPC ..... *E21B 27/00* (2013.01); *B65D 75/326* (2013.01); *B65D 75/327* (2013.01);
(Continued)

(58) Field of Classification Search
None
See application file for complete search history.

(56) References Cited

U.S. PATENT DOCUMENTS 3,577,700 A * 5/1971 Bippus ..... B29C 51/26 425/142
4,611,664 A 9/1986 Osterhoudt, III et al.
(Continued)

FOREIGN PATENT DOCUMENTS

EP 2059651 A1 5/2009
EP 2114553 A2 11/2009
(Continued)

OTHER PUBLICATIONS

International Search Report and Written Opinion; PCT Application No. PCT/US2015/059029; dated Aug. 3, 2016.

*Primary Examiner* — Andrew Sue-Ako
(74) *Attorney, Agent, or Firm* — Polsinelli PC

(57) ABSTRACT

Payload container and system for delivering a payload to a wellbore, the payload container includes a blister container having a cavity formed therein and an edge about the perimeter of the cavity, one or more payload substances contained within the cavity, a lidding material to cover the cavity, and optionally, an adhesive to bond the lidding material to the edge of the cavity, so that the one or more payload substances can be released in response to an external stimulus. The wellbore payload delivery system includes a plurality of payload containers and a pump system for injecting the one or more payload containers into a wellbore, the pump system has a pump and a length of tubing coupled with the pump and extending to a zone of a subterranean formation adjacent to the wellbore.

24 Claims, 7 Drawing Sheets

(51) Int. Cl.

| | |
|---|---|
| ***B65D 75/32*** | (2006.01) |
| *E21B 43/26* | (2006.01) |
| *E21B 21/00* | (2006.01) |
| *E21B 33/13* | (2006.01) |
| *E21B 37/06* | (2006.01) |
| *E21B 41/02* | (2006.01) |
| *E21B 43/16* | (2006.01) |

(52) U.S. Cl.
CPC ..... *B65D 75/367* (2013.01); *E21B 21/00* (2013.01); *E21B 33/13* (2013.01); *E21B 37/06* (2013.01); *E21B 41/02* (2013.01); *E21B 43/16* (2013.01); *E21B 43/26* (2013.01)

(56) References Cited

U.S. PATENT DOCUMENTS

| | | | | |
|---|---|---|---|---|
| 4,750,318 | A * | 6/1988 | Matsuzawa | B26D 3/085 53/559 |
| 4,986,353 | A | 1/1991 | Clark et al. | |
| 4,986,354 | A | 1/1991 | Clark et al. | |
| 7,073,581 | B2 | 7/2006 | Nguyen et al. | |
| 7,134,492 | B2 | 11/2006 | Willberg et al. | |
| 7,424,911 | B2 | 9/2008 | McCarthy et al. | |
| 7,891,424 | B2 * | 2/2011 | Creel | E21B 27/02 166/286 |
| 8,006,755 | B2 | 8/2011 | Bicerano | |
| 8,168,570 | B2 | 5/2012 | Barron et al. | |
| 8,183,184 | B2 | 5/2012 | Berkland et al. | |
| 8,372,786 | B2 | 2/2013 | Berkland et al. | |
| 8,393,395 | B2 | 3/2013 | Cochet et al. | |
| 8,448,706 | B2 | 5/2013 | Hughes et al. | |
| 8,459,353 | B2 | 6/2013 | Hughes et al. | |
| 8,939,205 | B2 | 1/2015 | Ersoz | |
| 2004/0115378 | A1 | 6/2004 | Dunaway et al. | |
| 2004/0168811 | A1 | 9/2004 | Shaw et al. | |
| 2008/0121825 | A1 * | 5/2008 | Trovato | A61N 5/1014 250/506.1 |
| 2009/0250216 | A1 | 10/2009 | Bicerano | |
| 2011/0209869 | A1 | 9/2011 | Smith | |
| 2011/0214488 | A1 | 9/2011 | Rose et al. | |
| 2012/0169343 | A1 | 7/2012 | Eick et al. | |
| 2013/0160998 | A1 | 6/2013 | Auzerais et al. | |
| 2013/0210684 | A1 * | 8/2013 | Ballard | C09K 8/52 507/201 |
| 2013/0292112 | A1 | 11/2013 | Davis | |
| 2013/0327524 | A1 | 12/2013 | Sangermano et al. | |
| 2014/0027116 | A1 * | 1/2014 | Suresh | C09K 8/56 166/292 |
| 2014/0110102 | A1 | 4/2014 | Hall | |
| 2014/0338905 | A1 | 11/2014 | Ersoz et al. | |

FOREIGN PATENT DOCUMENTS

| | | | |
|---|---|---|---|
| EP | 2628894 | A1 | 8/2013 |
| WO | 9322537 | A1 | 11/1993 |
| WO | 0212674 | A1 | 2/2002 |
| WO | 03106809 | A1 | 12/2003 |
| WO | 2004092540 | A1 | 10/2004 |
| WO | 2005017313 | A1 | 2/2005 |
| WO | 2006084981 | A1 | 8/2006 |
| WO | 2011051850 | A2 | 5/2011 |
| WO | 2012155045 | A2 | 11/2012 |
| WO | 2013154537 | A1 | 10/2013 |
| WO | 2014186174 | A1 | 11/2014 |
| WO | 2014207000 | A1 | 12/2014 |

* cited by examiner

DOWNHOLE PAYLOAD RELEASE CONTAINERS, METHOD AND SYSTEM OF USING THE SAME

CROSS-REFERENCE TO RELATED APPLICATIONS

This application is a national stage entry of PCT/US2015/059029 filed Nov. 4, 2015, said application is expressly incorporated herein in its entirety.

FIELD

The present disclosure relates generally to delivery of chemical payloads to subterranean formations. In particular, the present disclosure relates to delivery of chemical payloads to wellbores using a payload container which allows for the release or exposure of the payload to subterranean formation zones in response to an external stimulus.

BACKGROUND

A wide variety of chemicals and substances may be used within a wellbore in connection with producing hydrocarbons or reworking a well that extends into a hydrocarbon producing subterranean formation. Chemicals such as free radical initiators, catalysts (e.g. cement curing agents, gelling agents, mud-to-cement agents, etc.), acids, lubricants, contrast agents, acid gas scavenger materials, relative permeability modifiers, diverting agents, filter-cake breakers, sensors, explosives, and indicators, among other materials, are commonly used.

Various methods and materials have been employed for delivery of chemicals and substances to subterranean zones of interest.

BRIEF DESCRIPTION OF THE DRAWINGS

Implementations of the present technology will now be described, by way of example only, with reference to the attached figures, wherein.

Figure 1:
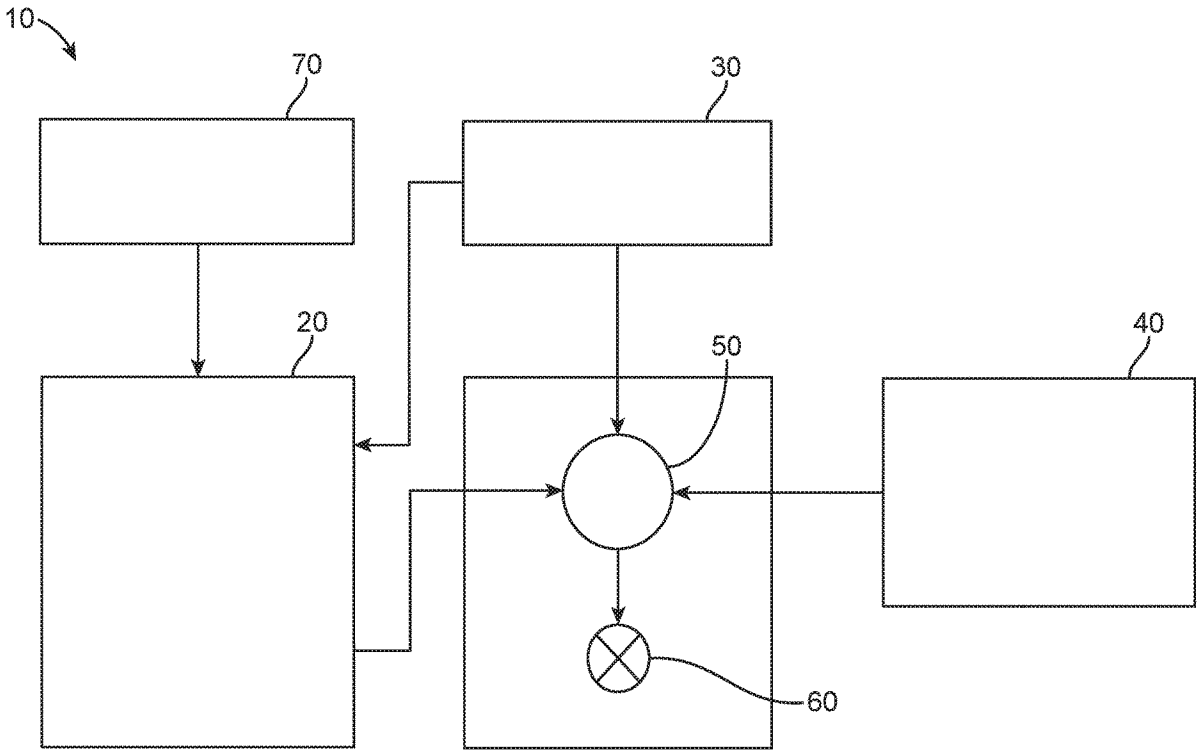
FIG. 1 is a diagram illustrating an example of a payload container delivery system that can be used in association with certain embodiments of the present disclosure.

It should be understood that the various embodiments are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or apparatus. Additionally, the illustrated embodiments are illustrated such that the orientation is such that the right-hand side or bottom of the page is downhole compared to the left-hand side, and the top of the page is toward the surface, and the lower side of the page is downhole. Furthermore, the term "proximal" refers directionally to portions further toward the surface in relation to the term "distal" which refers directionally to portions further downhole and away from the surface in a wellbore.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connections can be such that the objects are permanently connected or reversibly connected. The term "outside" refers to a region that is beyond the outermost confines of a physical object. The term "axially" means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but are not necessarily limited to, the things so described.

The present disclosure is directed to a payload container for delivering a payload to a subterranean zone via a wellbore. The payload container can include a blister container having a cavity formed therein and an edge about the perimeter of the cavity. The cavity can be a single cavity. The cavity can be separated into two or more subcavities, each subcavity separated by a barrier. Each barrier can be made of the same material as the blister container or be made of different materials. The payload container further includes a lidding material. The lidding material is mated, coupled with, or otherwise bonded to the blister container to seal or enclose the cavity. The lidding material can be mated with, coupled with, or otherwise bonded to the edge about the perimeter of the cavity.

The payload container further includes one or more payload substances contained within the blister container. When the blister container has a single cavity, one or more payload substances can be located in the single cavity. When the blister container has two or more subcavities, each subcavity can have a single payload substance or multiple payload substances. The composition of the payload container is configured to degrade or become compromised in response to an external stimulus. Upon degradation or compromise of the payload container, the one or more payload substances contained therein is exposed or released from the payload container to interact with a subterranean zone downhole in a well bore.

The payload container can have varying shapes. The payload container can be uniform or irregular, symmetrical or asymmetrical in shape. The payload container can be spherical, semi-spherical, ovoidal, semi-ovoidal, cubic, cylindrical, barrel-shaped, pyramidal (square, triangular, hexagonal or otherwise), parallel or slanted prismatic (triangular, square, rectangular, hexagonal or otherwise), star-shaped, conical, frustoconical, rhombohedral, trapezoidal, or any other suitable shape.

The payload container can have varying sizes and aspect ratios. In some instances, the payload container can have a width or length to height aspect ratio of from 1:0.1 to 1:10, or alternatively from 1:0.2 to 1:5, or alternatively from 1:0.5 to 1:2 or combinations thereof. The width to length aspect ratio may be from 10:1 to 1:10, or alternatively from 5:1 to 1:5, or alternatively from 2:1 to 1:2, or combinations thereof. The width or length can be any one of a diameter, a Feret diameter or a cross-sectional distance from one side to another opposite lateral side of the container in a plane parallel to the lidding material, and wherein the length and width are perpendicular to one another. The height of the payload container can be a measured from a bottom of the cavity to the lidding material. For example, each of the length, width and/or height independently of one another, can be from 0.5 to 20 mm, or alternatively 1 to 10 mm, or alternatively 1 to 5 mm, or combinations thereof. Also, for example, a payload container having a length, width and height of 4 mm×1 mm×1 mm would have an aspect ratio of 4:1.

The lidding material can be mated, coupled, or otherwise bonded with the edge of the blister container using an adhesive. The adhesive can be a thermoset adhesive, a solvent-based adhesive, an aqueous adhesive, or any combination thereof. Alternatively, the lidding material can be mated, coupled, or otherwise bonded with the edge of the blister container by heat, solvent, or ultrasonic bonding, or hot, cold, or solvent lamination, any combination thereof, or any other suitable method known to one of skill in the art. The lidding material can be made of a metal foil, a polymeric material, a resin, a woven material, a non-woven material, or any combination thereof. The lidding material can be provided as a pre-formed sheet. The lidding material can alternatively be provided as a bulk material, such as, for example, a resin or wax, which is formed into a sheet upon mating with, coupling with, or otherwise bonding to the blister container.

The blister container can be made of a thermoplastic material. The thermoplastic material can be any one of a polystyrene, a polyvinyl chloride, a polyethylene terephthalate glycol, a polyethylene, and a polypropylene, a polyacrylate, a poly(methyl methacrylate), a polyester, a polylactic acid, a polyglycolic acid, or any other suitable method known to one of skill in the art.

The payload container can have one or more chemical agents, as the payload, contained or encapsulated within the cavity or subcavities. Suitable chemical agents include any chemical agent suitable for use in a subterranean formation. Examples of suitable chemical agents include, but are not limited to, free radical initiators, catalysts (e.g. cement curing agents, gelling agents, mud-to-cement agents, etc.), lubricants, contrast agents, acid gas scavenger materials (for $H_2S$, $CO_2$, etc.), scale inhibitors, corrosion inhibitors, biocides, paraffin inhibitors, asphaltene inhibitors, gas hydrate inhibitors, relative permeability modifiers or fluid loss control agents, loss circulation control agents, filter-cake breakers, surfactants, dispersants, accelerators, retarders, extenders, weighting agents, gases, blowing (or foaming) agents, explosives, sensors, and indicators. The chemical agents can be in any state, however condensed states such as liquids or solids are preferred due to the relatively small volume of each package.

As described above, the payload container is configured to degrade or become compromised in response to an external stimulus. The external stimulus can be, but is not limited to, a change in isotropic pressure, a change in anisotropic pressure, a change in temperature, one or more chemical reagents, air, water, hydrocarbons, radiation, any other suitable stress-inducing event or environment (that is, a stressor), or any combination thereof. The payload container can be configured such that only the blister container degrades or becomes compromised in response to an external stimulus, the lidding material degrades or become compromised in response to an external stimulus, the adhesive or bond between the blister container and lidding material degrades or becomes compromised in response to an external stimulus, or any combination thereof.

The payload container can maintain containment of payload substances in excess of 125° C., alternatively in excess of 150° C., and alternatively in excess of 175° C. The payload can also maintain containment of payload substances at an isotropic pressure ranging from 0.5-30 kPSI.

One or more external surfaces of the payload container can be modified to have varying physical properties. Physical modifications of the payload container can be made to enhance or otherwise alter the interaction of the payload container with an external stimulus. In some instances, one or more external surfaces of the blister container and/or the lidding material can be modified to be roughened, grooved, corrugated, or otherwise textured. Formation of textured surfaces can be accomplished by, for example, chemical or plasma etching, mechanical means such as grinding, molding, embossing, or the use of abrasives, or any other suitable means to texture one or more external surfaces of the payload container. Roughening, grooving, corrugating, or otherwise texturing the payload container can increase the surface area of the payload container to enhance the rate of degradation via chemical reactivity when in the presence of external stimulus such as, for example, chemical reagents, methane, air, water, hydrocarbons or other liquid- or gas-phase chemical species. Roughening, grooving, corrugating, or otherwise texturing the payload container can also result in a lowered structural stability of the payload container to enhance degradation when in the presence of, for example, changes in isotropic pressure, changes in anisotropic pressure, changes in temperature, or other physical external stimulus.

One or more external surfaces of the payload container can be modified to have varying chemical properties.

Chemical modifications of the payload container can be made to enhance or otherwise alter the interaction of the payload container with an external stimulus. Chemical modifications can be added by functionalization of one or more external surfaces with desired chemical species. Chemical modifications can alternatively be added by coating one or more of the external surfaces with one or more layers of a chemical compound containing desired chemical species. The chemical groups can be, but not limited to, hydrophobic, hydrophilic, amphiphilic, or zwitterionic in nature, or any combination thereof. Exemplary chemical species can include, but are not limited to, alkanes, alkenes, alkynes, alcohols, aromatics, ethers, esters, aldehydes, ketones, carboxylates, carbonates, acyl halides, nitriles, nitrides, nitros, nitrosyls, amines, amides, azides, imines, imides, cyanates, nitrates, sulfides, sulfoxides, sulfones sulfonates, sulfonate esters, thiols, phosphines, phosphites, phosphates, halogens, haloalkanes, hydroxysilanes, alkoxysilanes, alkylsilanes, arylsilanes, siloxanes, zwitterions such as, for example, alkyl- or arylammonium ions or alkyl- or arylphosphonium ions, any combination thereof, or any other suitable functional group. Chemical species can also include any one of the above in combination with metal species such as, for example, metal cations, metal nanoparticles, metal oxide nanoparticles, or any combination thereof, wherein the chemical species acts as a ligand for coordination of the metal species. Chemical modification, by way of functionalization or coating, can be accomplished by any chemical reaction or pathway known to one of skill in the art. One of skill in the art will readily appreciate that the chemical reactions or pathways chosen will be dependent on the choice of blister container, lidding material, or both.

One or more external surfaces of the payload container can be porous or modified to be porous. The pores can extend from an external surface of the payload container to the cavity. The pores can be nanoporous (that is, less than 2 nm in diameter), microporous (that is, between 2 nm and 50 nm in diameter) or macroporous (that is, greater than 50 nm in diameter), or any combination thereof. The diameter of the pores can be chosen on a case-by-case basis depending on factors such as, but not limited to, the physical or chemical properties of the payload substance contained within the porous payload container, the external stimulus or stimulus used to degrade the porous payload container, the rate of degradation of the porous payload container in presence of the external stimulus or stimulus, the desired rate of release of the payload substance from the porous payload container, or combinations thereof.

In some instances, the pores of the porous payload container can be plugged with a stimulus-responsive material. The stimulus-responsive material will be encapsulated within the pores of the porous payload material until introduced to an external stimulus. In one instance, upon interaction with the external stimulus, the stimulus-responsive material will degrade, unplugging the pores, and allow for fluid communication between the cavity and the external environment. In other instances, upon interaction with the external stimulus, the pores will swell or become enlarged, and the resulting increase in pore diameter will allow the stimulus-responsive material to be released from the pores, unplugging the pores, and allow for fluid communication between the cavity and the external environment.

ILLUSTRATIONS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

FIG. 1 is a diagram illustrating an example of a payload container delivery system that can be used in association with certain embodiments of the present disclosure. The exemplary methods and compositions disclosed herein may directly or indirectly affect one or more components or pieces of equipment associated with the preparation, delivery, recapture, recycling, reuse, and/or disposal of the disclosed compositions. For example, and with reference to FIG. 1, the disclosed methods and compositions may directly or indirectly affect one or more components or pieces of equipment associated with an exemplary payload container delivery system 10, according to one or more embodiments. In certain instances, the system 10 includes a payload container source 20, a fluid source 30, an additive source 40, and a pump and blender system 50 and resides at the surface at a well site where a well 60 is located. In other instances, the payload container source 20 can be omitted and the payload container-containing fluid sourced directly from the fluid source 30. In certain instances, the fracturing fluid may comprise water, a hydrocarbon fluid, a polymer gel, foam, air, wet gases and/or other fluids.

The additive source 40 can include an additive for combination with the payload container-containing fluid. The additive can be, for example, free radical initiators, catalysts (e.g. cement curing agents, gelling agents, mud-to-cement agents, etc.), lubricants, contrast agents, acid gas scavenger materials (for $H_2S$, $CO_2$, etc.), scale inhibitors, corrosion inhibitors, biocides, paraffin inhibitors, asphaltene inhibitors, gas hydrate inhibitors, relative permeability modifiers or fluid loss control agents, loss circulation control agents, filter-cake breakers, surfactants, dispersants, accelerators, retarders, extenders, weighting agents, and/or other optional additives. The system may also include a second additive source 70 that provides one or more additives, different from the additive from additive source 40, to alter the properties of the payload container-containing fluid.

The pump and blender system 50 receives the payload container-containing fluid and combines it with other components from the additive source 40 and/or additional fluid from the second additive source 70. The resulting mixture may be pumped down the well 60 under a pressure sufficient to deliver the payload container-containing fluid to a subterranean zone or fracture within or adjacent to the subterranean zone. Notably, in certain instances, the payload container source 20, fluid source 30, and/or additive source 40 may be equipped with one or more metering devices (not shown) to control the flow of the payload container-containing fluid, additives and/or other compositions to the pumping and blender system 50. Such metering devices may permit the pumping and blender system 50 to source from one, some or all of the different sources at a given time, and may facilitate the preparation of fluid mixtures in accordance with the present disclosure using continuous mixing or "on-the-fly" methods. Thus, for example, the pumping and blender system 50 can provide just payload container-containing fluid into the well at some times, just additives at other times, and combinations thereof at yet other times.

Figure 2:
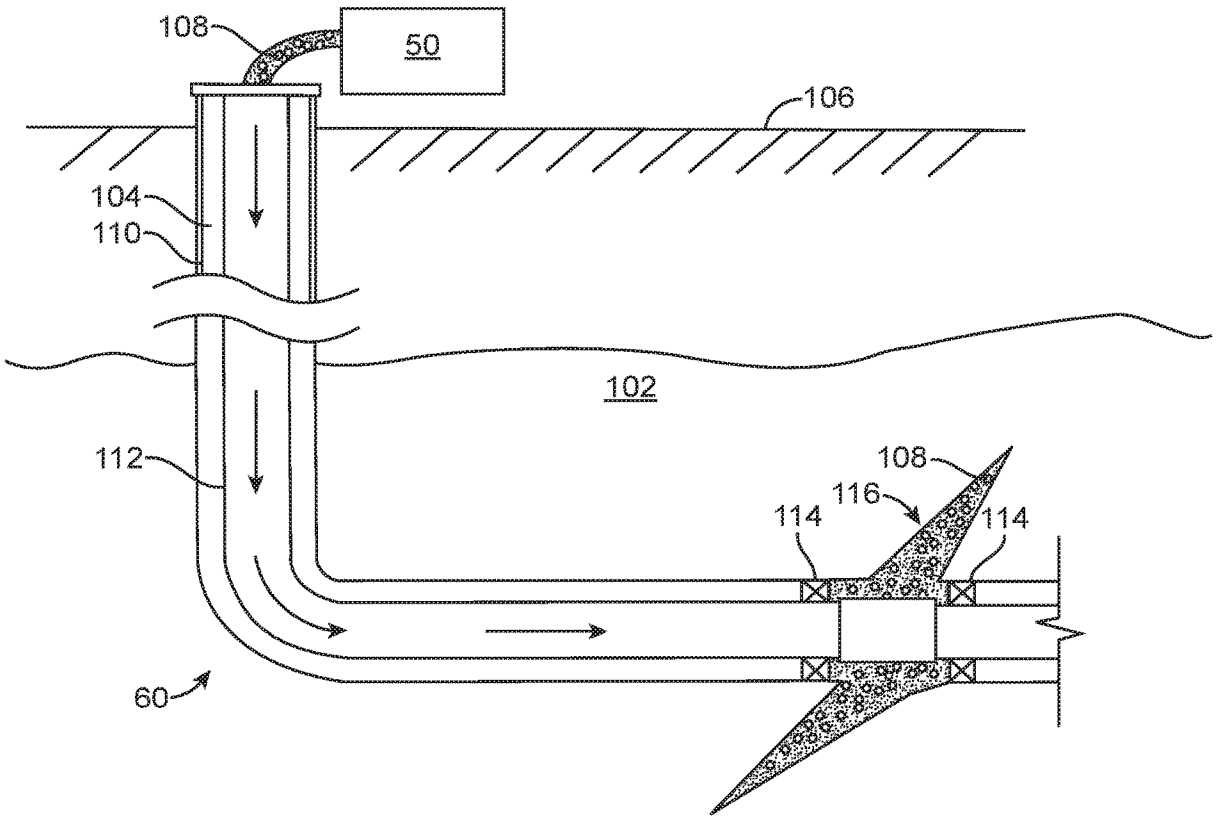
FIG. 2 is a diagram illustrating an example of a subterranean formation in which a payload container delivery operation can be performed in association with certain embodiments of the present disclosure.

FIG. 2 is a diagram illustrating an example of a subterranean formation in which a payload container delivery operation can be performed in association with certain embodiments of the present disclosure. FIG. 2 shows the well 60 during a payload container delivery operation in a portion of a subterranean formation of interest 102 surrounding a well bore 104. The well bore 104 extends from the surface 106, and the payload container-containing fluid 108 is applied to a portion of the subterranean formation 102 surrounding the horizontal portion of the well bore. Although shown as vertical deviating to horizontal, the well bore 104 may include horizontal, vertical, slant, curved, and other types of well bore geometries and orientations, and the injection of payload container-containing fluid 108 may be applied to a subterranean zone surrounding any portion of the well bore 104. The well bore 104 can include a casing 110 that is cemented or otherwise secured to the well bore wall. The well bore 104 can be uncased or include uncased sections.

The well 60 is shown with a work string 112 extending from the surface 106 into the well bore 104. The pump and blender system 50 is coupled with a work string 112 to pump the payload container-containing fluid 108 into the well bore 104. The working string 112 may include coiled tubing, jointed pipe, and/or other structures that allow fluid to flow into the well bore 104. The working string 112 can include flow control devices, bypass valves, ports, and or other tools or well devices that control a flow of fluid from the interior of the working string 112 into the subterranean zone 102. For example, the working string 112 may include ports adjacent the well bore wall to communicate the payload container-containing fluid 108 directly into the subterranean formation 102, and/or the working string 112 may include ports that are spaced apart from the well bore wall to communicate the payload container-containing fluid 108 into an annulus in the well bore between the working string 112 and the well bore wall.

The working string 112 and/or the well bore 104 may include one or more sets of packers 114 that seal the annulus between the working string 112 and well bore 104 to define an interval of the well bore 104 into which the payload container-containing fluid 108 will be pumped. FIG. 2 shows two packers 114, one defining an uphole boundary of the interval and one defining the downhole end of the interval. When the payload container-containing fluid 108 is introduced into well bore 104 (for example, in FIG. 2, the area of the well bore 104 between packers 114) at a sufficient hydraulic pressure, the payload container-containing fluid 108 can enter the one or more fractures 116 in the subterranean zone 102.

While not specifically illustrated herein, the disclosed methods and compositions may also directly or indirectly affect any transport or delivery equipment used to convey the compositions to the payload container delivery system 10 such as, for example, any transport vessels, conduits, pipelines, trucks, tubulars, and/or pipes used to fluidically move the compositions from one location to another, any pumps, compressors, or motors used to drive the compositions into motion, any valves or related joints used to regulate the pressure or flow rate of the compositions, and any sensors (i.e., pressure and temperature), gauges, and/or combinations thereof, and the like.

Figure 3:
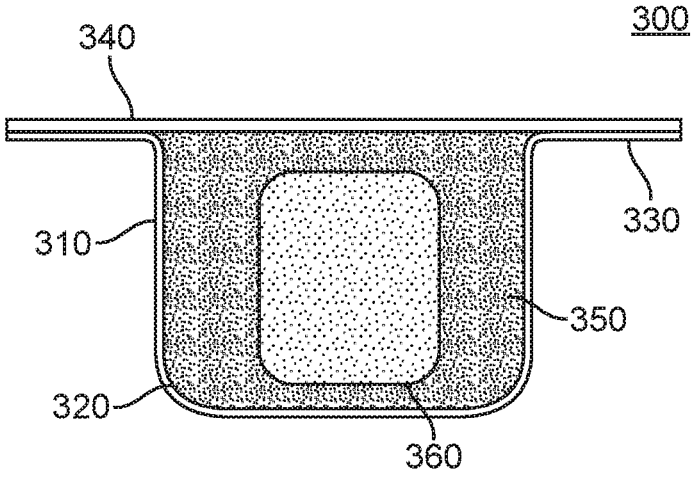
FIG. 3 is a diagram of an exemplary payload container in association with certain embodiments of the present disclosure.

FIG. 3 is a diagram of a cross-sectional view of an exemplary payload container. As shown, payload container 300 includes a blister container 310, a lidding material 340, and a cavity 320 therein. The lidding material 340 is bonded with or adhered to the blister container 310 along an edge 330 of the blister container 310. The cavity 320 contains a first payload material 350 and a second payload material 360 encapsulated in the first payload material 350. In some instances, the lidding material 340 is bonded with or adhered to the blister container 310 along an edge 330 of the blister container 310 using heat, solvent, or ultrasonic bonding, or hot, cold, or solvent lamination, any combination thereof, or any other suitable method known to one of skill in the art. In other instances, the lidding material 340 is bonded with or adhered to the blister container 310 along an edge 330 of the blister container 310 using a layer of adhesive. The adhesive can be a thermoset adhesive, pressure sensitive adhesives a solvent-based adhesive, an aqueous adhesive, or any combination thereof. Examples of thermoset adhesives include, but are not limited to, epoxy resins, phenolic formaldehyde resins, phenolic neoprene, resorcinol formaldehydes, polyesters, polyimides, epoxy polysulphides, redux adhesives, nitrocellulose, polyurethanes, dextrin, albumen, lingin and multi-part adhesives such as, for example, ethylene-vinyl acetate, polyester resin-polyurethane resin, polyols-polyurethane resin, and acrylic polymers-polyurethane resins. Pressure-sensitive adhesives can include, but are not limited to acrylics, butyl or natural rubber, nitriles, silicone rubber, styrene block copolymers, and vinyl ethers.

Figure 4:
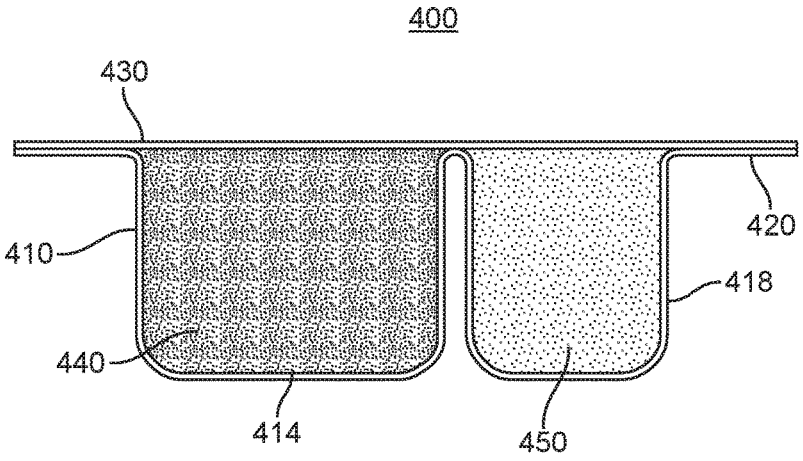
FIG. 4 is a diagram of another exemplary payload container in association with certain embodiments of the present disclosure.

FIG. 4 is a diagram of a cross-sectional view of another exemplary payload container. As shown, payload container 400 includes a blister container 410, a first cavity 414 and a second cavity 418 situated horizontal relative to each other, and a lidding material 430. The lidding material 430 is bonded with or adhered to the blister container 410 along an edge 420 of the blister container 410. The first cavity 414 and the blister cavity 418 contain a first payload material 440 and a second payload material 450 respectively. In some instances, the lidding material 430 is bonded with or adhered to the blister container 410 along an edge 420 of the blister container 410 using heat, solvent, or ultrasonic bonding, or hot, cold, or solvent lamination, any combination thereof, or any other suitable method known to one of skill in the art. In other instances, the lidding material 430 is bonded with or adhered to the blister container 410 along an edge 420 of the blister container 410 using a layer of adhesive. The adhesive can be a thermoset adhesive, a pressure-sensitive adhesive, a solvent-based adhesive, an aqueous adhesive, or any combination thereof.

Figure 5:
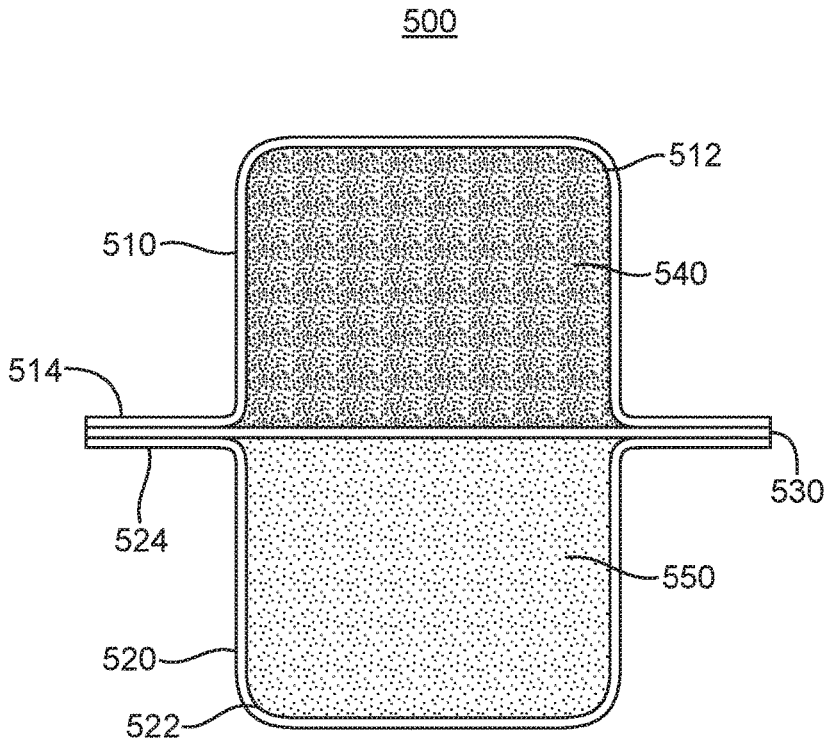
FIG. 5 is a diagram of yet another exemplary payload container in association with certain embodiments of the present disclosure.

FIG. 5 is a diagram of a cross-sectional view of yet another exemplary payload container. As shown, payload container 500 includes a first blister container 510 and a first cavity 512, a second blister container 520 and a second cavity 522, and a lidding material 530. Cavities 512, 522 are situated vertical relative to each other. The lidding material 530 is bonded with or adhered to the blister containers 510, 520 along an edge 514 of the first blister container 510 and an edge 524 of the second blister container 520. The first cavity 512 and the second cavity 522 contain a first payload material 540 and a second payload material 550 respectively.

In some instances, the lidding material 530 is first bonded with or adhered to the first blister container 510 along the edge 514 of the first blister container 510 using heat, solvent, or ultrasonic bonding, or hot, cold, or solvent lamination, any combination thereof, or any other suitable method known to one of skill in the art. The lidding material 530 is then bonded with or adhered to the second blister container 520 along the edge 524 of the second blister container 520 using heat, solvent, or ultrasonic bonding, or hot, cold, or solvent lamination, any combination thereof, or any other suitable method known to one of skill in the art.

In another instance the lidding material 530 is first bonded with or adhered to the first blister container 510 along the edge 514 of the first blister container 510 using a layer of adhesive. The lidding material 530 is then bonded with or adhered to the second blister container 520 along the edge 524 of the second blister container 520 using a layer of adhesive. The adhesive can be a thermoset adhesive, a pressure-sensitive adhesive, a solvent-based adhesive, an aqueous adhesive, or any combination thereof. The adhesive used to bind or adhere the first blister container 510 to the lidding material 530 and the adhesive used to bind or adhere the second blister container 520 to the lidding material 530 can be the same or different.

In yet another instance, the lidding material 530 is first bonded with or adhered to the first blister container 510 along the edge 514 of the first blister container 510 using heat, solvent, or ultrasonic bonding, or hot, cold, or solvent lamination, any combination thereof, or any other suitable method known to one of skill in the art. The lidding material 530 is then bonded with or adhered to the second blister container 520 along the edge 524 of the second blister container 520 using a layer of adhesive. The adhesive can be a thermoset adhesive, a pressure-sensitive adhesive, a solvent-based adhesive, an aqueous adhesive, or any combination thereof.

In another instance the lidding material 530 is first bonded with or adhered to the first blister container 510 along the edge 514 of the first blister container 510 using a layer of adhesive. The adhesive can be a thermoset adhesive, a pressure-sensitive adhesive, a solvent-based adhesive, an aqueous adhesive, or any combination thereof. The lidding material 530 is then bonded with or adhered to the second blister container 520 along the edge 524 of the second blister container 520 using heat, solvent, or ultrasonic bonding, or hot, cold, or solvent lamination, any combination thereof, or any other suitable method known to one of skill in the art.

Figure 6:
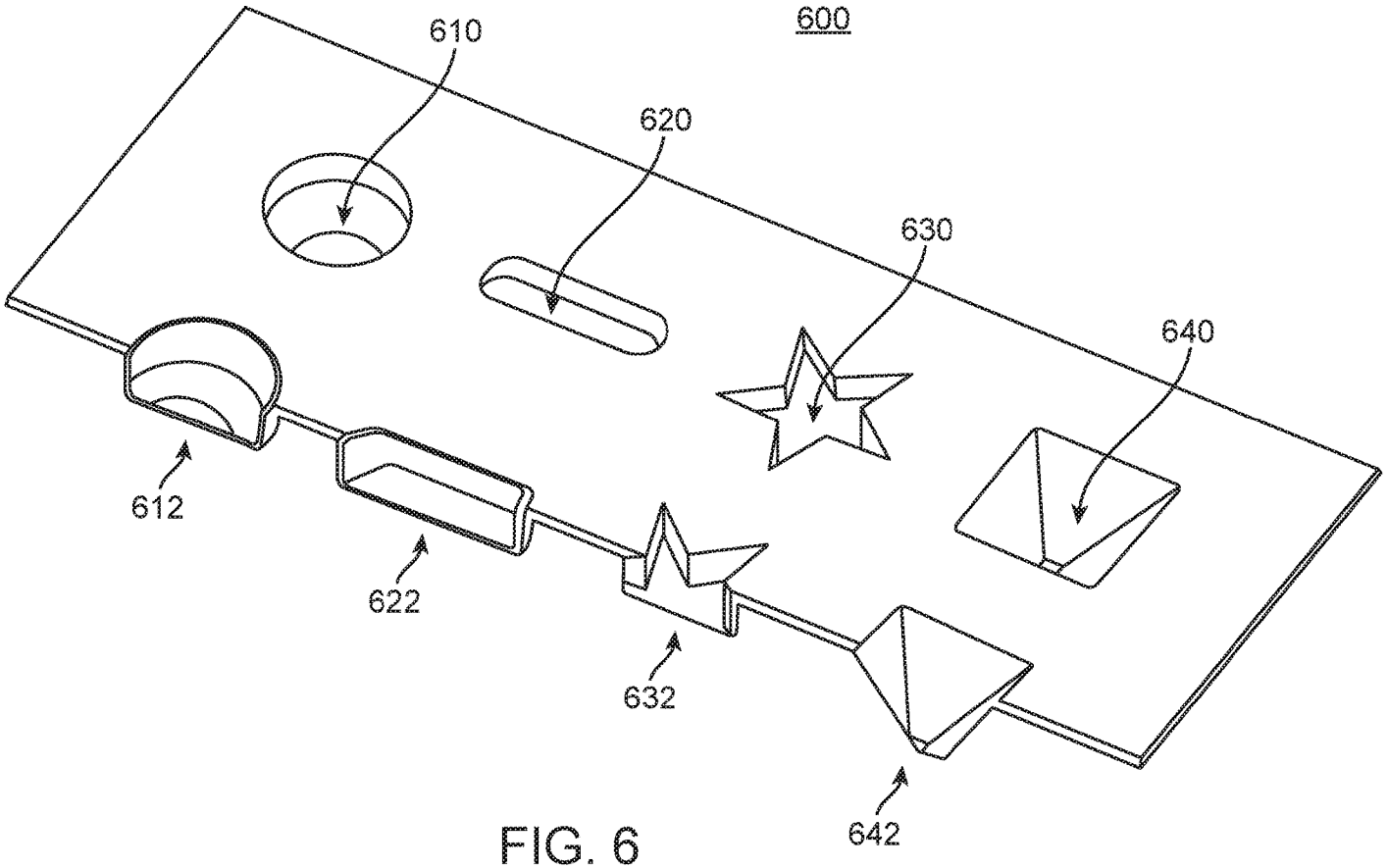
FIG. 6 is a diagram of an exemplary blister sheet for use in the fabrication of a payload container in association with certain embodiments of the present disclosure.

FIG. 6 is a diagram of an exemplary blister sheet for use in the fabrication of a payload container. The exemplary blister sheet 600 shows four exemplary cavity shapes. The first cavity shape is a shallow cylinder 610 having a cross-section 612. The second cavity shape is in the form of an oblong pill 620 having a cross-section 622. The third cavity shape is a star 630 having a cross-section 632. The fourth cavity shape is a square pyramid 640 having a cross-section 642. The cavities can have varying shapes. The cavities can be uniform or irregular, symmetrical or asymmetrical in shape. The cavities can be spherical, semi-spherical, ovoidal, semi-ovoidal, cubic, cylindrical, barrel-shaped, pyramidal (square, triangular, hexagonal or otherwise), parallel or slanted prismatic (triangular, square, rectangular, hexagonal or otherwise), star-shaped, conical, frustoconical, rhombohedral, trapezoidal, or any other suitable shape.

Figure 7:
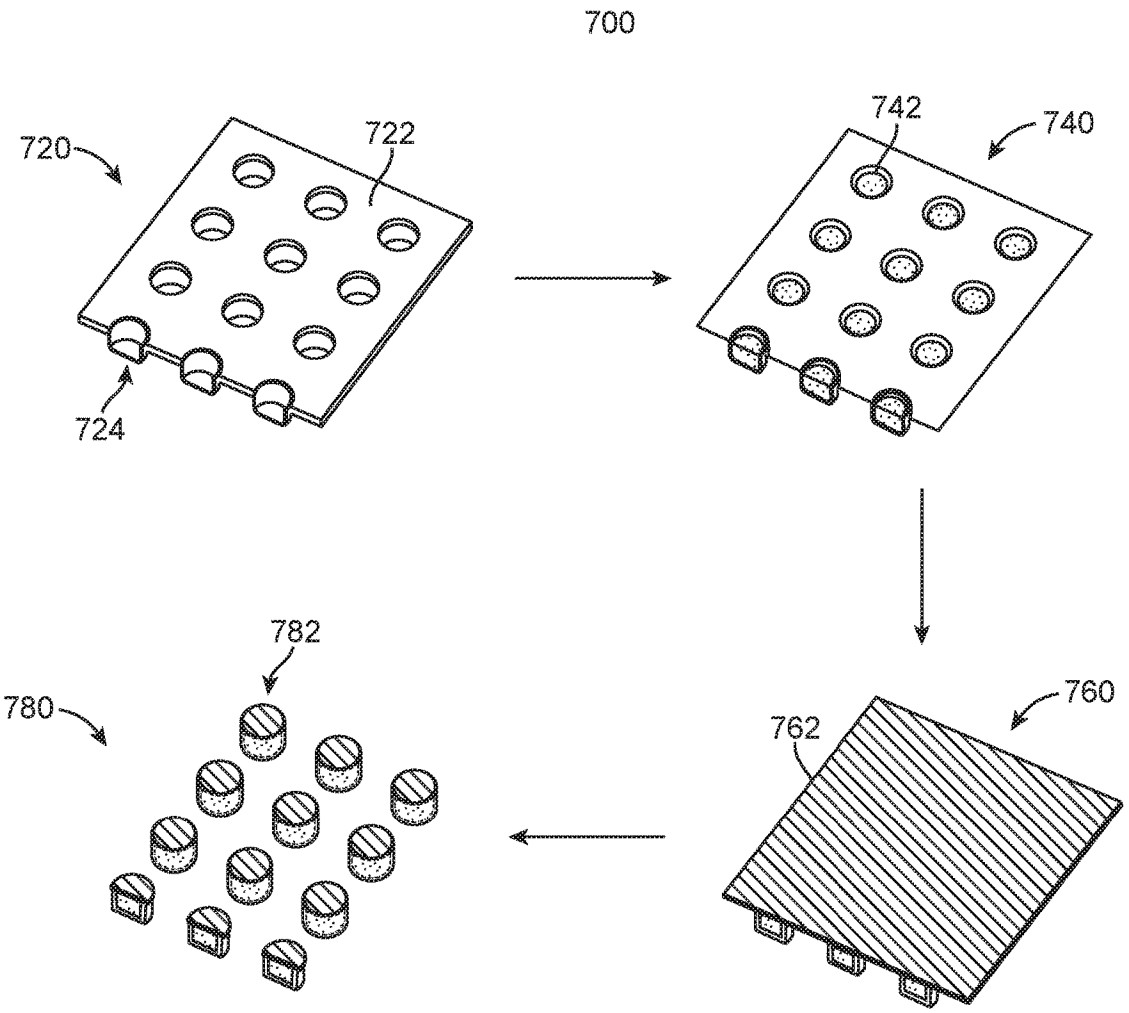
FIG. 7 is diagram of an exemplary method of making a payload container with a payload contained therein in association with certain embodiments of the present disclosure.

FIG. 7 is diagram of an exemplary method of making a payload container with a payload contained therein. As shown, the exemplary method 700 comprises four steps. In step 720, a blister sheet 722 having a plurality of cavities 724 is provided. In step 740, a payload material 742 is placed in one or more of the cavities 724. In step 760, a lidding material 762 is placed over the blister sheet 722 and payload filled cavities 724. The lidding material 762 is then bonded with or adhered to the blister sheet 722 as previously described. In step 780, individual payload containers 782, each comprising a cavity 724 filled with the payload material 742 and a lidding material 762 bonded with or adhered to the blister sheet 722, is punched out of the blister sheet 722. The punching out process of step 780 results in each payload container 782 having an edge as described in FIG. 3.

Payload containers can also be formed using the following exemplary method. In a first step, a blister sheet having a plurality of cavities is provided. In a second step, a plurality of blister containers, each comprising a cavity and an edge (see FIG. 3) can be punched out of the blister sheet. In a third step, each of the cavities can be filled with one or more payload materials. In a fourth step, a single sheet of lidding material can be placed along a top portion of the edge of each blister container, covering the one or more payload materials, and the lidding material can be bonded with or adhered to the edge of the blister container as described above. The lidding material not bonded with or adhered to a blister container can be removed to form the final payload container. Payload containers employing the blister sheet can also be formed in a roll to roll process.

PROPHETIC EXAMPLES

Example 1

In Example 1, a payload container was made of polyethylene terephthalate glycol-modified (PETG) with 50 μm thick walls. The cavity of the payload container had a 1 mm circular cross section, was 1 mm deep and has planar side walls. The cavity was filled with a combination of a cylindrical lead azide pellets and a loose powder comprised of a stoichiometric mixture of magnesium and silver nitrate. The cavity was sealed with a 25 μm aluminum foil sheet using a silicone based pressure sensitive adhesive. The final payload container of Example 1 is structurally similar to payload container 300 (See FIG. 3).

Prophetic Example 2

In Example 2, a payload container comprising a single elliptical cavity with a 4 mm major radius and 1 mm minor radius is formed from a 150 μm PETG sheet. The blister container is 1 mm deep and has rounded side walls. The cavity is filled with a biocide powder additive for hydraulic fracturing fluids. The cavity is sealed with a 25 μm thick, degradable, polylactic acid polymer film.

Example 3

In Example 3, a payload container comprising two horizontally adjacent cavities formed into a polystyrene sheet with 100 μm thick walls was made. The two cavities had square cross sections and were filled with components A and B of a two part energetic substance. The cavities were sealed with a 100 μm polystyrene lidding sheet using a solvent based adhesive (See, for example, FIG. 4).

Prophetic Example 4

In Example 4, two payload containers are made using to 100 μm thick polystyrene walls. The cavities of each payload container have square cross-sections and are filled with components A and B of a two part energetic substance. Each cavity is sealed using the same 100 μm polystyrene lidding sheet using a pressure or temperature based adhesive, binding the two payload containers together to form a unified payload container such that the payload containers are vertically adjacent to each other (See, for example, FIG. 5).

Prophetic Example 5

In a payload container formed from Experiment 1 or Experiment 2, a buoyant payload container can be made by encapsulating a proppant particle and a gas and/or blowing agent. The blister container, lidding material, or both can be slowly degrading thermoplastic.

Prophetic Example 6

In a payload container formed from Experiment 3 or Experiment 4, a buoyant payload container can be made by encapsulating a proppant particle in a first cavity and a gas in a second cavity. If the payload container is formed using Experiment 3, the blister container, lidding material, or both can be slowly degrading thermoplastic. If the payload container is formed using Experiment 4, the thermoplastic of the first payload container and the thermoplastic of the second payload container can be the same or different.

Prophetic Example 7

In a payload container formed from Experiment 1 or Experiment 2, a payload container containing an encapsulated gas and/or blowing agent (volatile liquid) can be made for controlling the density of cement or drilling mud. The blister container, lidding material, or both can be slowly degrading thermoplastic.

Prophetic Example 8

In a payload container formed from Experiment 1 or Experiment 2, Improving diverter materials at perforations for multi-stage fracking: Use PLA compositions outside or inside of encapsulation+dissolvable/degradable polymers, fibers, metal nanoparticles. The blister container, lidding material, or both can be slowly degrading thermoplastic.

Prophetic Example 9

In a payload container formed from Experiment 1 or Experiment 2, a payload container having a plurality of radiation emitting or magnetic tracers encapsulated in a degradable polymer or a polymer with known diffusion properties can be made. The blister container, lidding material, or both can be slowly degrading thermoplastic.

Prophetic Example 10

In a payload container formed from Experiment 1 or Experiment 2, one or more scale inhibitors, corrosion inhibitors, biocides, paraffin inhibitors, asphaltene inhibitors, gas hydrate inhibitors can be provided in the blister cavity for use in flow assurance applications. The blister container, lidding material, or both can be slowly degrading thermoplastic. Alternatively, the blister container, lidding material, or both can be porous to allow diffusion of the payload over time.

Prophetic Example 11

In a payload container formed from Experiment 3 or Experiment 4, a curable resin (for example, a WellLock® resin) can be contained within a cavity, to heal damage, stop cracks & gas influxes, and a retarder or accelerator can be placed within the second cavity. If the payload container is formed using Experiment 3, the blister container can be slowly degrading thermoplastic. If the payload container is formed using Experiment 4, the thermoplastic of the first payload container and the thermoplastic of the second payload container can be different thermoplastics, wherein the payload container containing the curable resin is designed to degrade before the payload container containing the retarder or accelerator.

Prophetic Example 12

In a payload container formed from Experiment 4, a first cavity can have a first chemical composition and a second cavity can have a second chemical composition. Upon degradation of the first and second payload containers, or of the lidding material therebetween, the first and second chemical compositions can mix to form a 2-stage resin (such as, for example, a 2-stage epoxy resin) which, upon curing downhole, forms an annular barricade against water and gas leaks.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A payload container for delivering a payload to a wellbore, the payload container comprising:

a blister container having a cavity formed therein with an edge about the perimeter of the cavity;

one or more payload substances contained within the cavity;

a lidding material to cover the cavity;

whereby the lidding material is bonded to the edge of the cavity so that the one or more payload substances can be released in response to an external stimulus, wherein one or more of an external surface of the blister container and an external surface of the lidding material is porous, and wherein one or more pores of the external surface of the blister container and/or the external surface of the lidding material is plugged with a stimulus-responsive material that will either degrade or cause the pores to swell or enlarge upon interaction with the external stimulus.

2. The payload container of claim 1, wherein the external stimulus occurs downhole in the wellbore and comprises a change in isotropic pressure, a change in anisotropic pressure, a change in temperature, one or more chemical reagents, air, water, hydrocarbons, radiation, or any combination thereof.

3. A method of delivering a substance into a wellbore, the method comprising:

injecting a plurality of payload containers containing a payload substance into a wellbore, wherein a portion of the plurality of payload containers releases the payload substance in response to an external stimulus within the wellbore;

wherein each of the plurality of payload containers comprise:

a blister container having a cavity formed therein;

a lidding material bonded with the blister container enclosing the cavity, the payload substance contained within the enclosed cavity, wherein one or more pores of an external surface of the blister container and/or an external surface of the lidding material is plugged with a stimulus-responsive material that will either degrade or cause the pores to swell or enlarge upon interaction with the external stimulus;

wherein the plurality of payload containers are formed in a blister sheet and each of the plurality of payload containers are punched from the blister sheet prior to injecting the plurality of payload containers into the wellbore, whereby the lidding material is bonded to the edge of the cavity so that the payload substance can be released in response to an external stimulus.

4. A method of delivering a substance into a wellbore, the method comprising:

injecting a plurality of payload containers containing a payload substance into a wellbore, wherein a portion of the plurality of payload containers releases the payload substance in response to an external stimulus within the wellbore;

wherein each of the plurality of payload containers comprise:

a blister container having a cavity formed therein;

a lidding material bonded with the blister container enclosing the cavity, the payload substance contained within the enclosed cavity, wherein the lidding material and blister container of each payload container are made of different material, wherein the plurality of payload containers are formed in a blister sheet and each of the plurality of payload containers are punched from the blister sheet prior to injecting the plurality of payload containers into the wellbore, whereby the lidding material is bonded to the edge of the cavity so that the payload substance can be released in response to an external stimulus, wherein one or more of an external surface of the blister container and an external surface of the lidding material is porous, and wherein one or more pores of the external surface of the blister container and/or the external surface of the lidding material is plugged with a stimulus-responsive material that will either degrade or cause the pores to swell or enlarge upon interaction with the external stimulus.

5. The method of claim 4, wherein the lidding material is bonded to the blister container by heat bonding, solvent bonding, ultrasonic bonding, a thermoset adhesive, a solvent-based adhesive, an aqueous adhesive, or any combination thereof.

6. The method of claim 4, wherein the wellbore carrier fluid comprises a drilling fluid, a fracturing fluid, a mudding fluid, a cementing fluid, a completion fluid, a displacement fluid, a diverter fluid, a stimulation fluid, a treatment fluid, saltwater, freshwater, brine, air, a stable foam, or any combination thereof.

7. A wellbore payload delivery system, the system comprising:

a plurality of payload containers, each payload container comprising:

a blister container having a cavity formed therein;

a lidding material bonded with the blister container enclosing the cavity;

a payload substance contained within the cavity, and wherein the lidding material and blister container of each payload container are made of different material, wherein the plurality of payload containers are formed in a blister sheet and each of the plurality of payload containers are punched from the blister sheet, whereby the lidding material is bonded to the edge of the cavity so that the payload substance can be released in response to an external stimulus, wherein one or more of an external surface of the blister container and an external surface of the lidding material is porous, and wherein one or more pores of the external surface of the blister container and/or the external surface of the lidding material is plugged with a stimulus-responsive material that will either degrade or cause the pores to swell or enlarge upon interaction with the external stimulus;

a pump system for injecting the one or more payload containers into a wellbore, the pump system comprising:

a pump; and a length of tubing coupled with the pump and extending to a zone of a subterranean formation adjacent to the wellbore.

8. The system of claim 7, wherein the lidding material is bonded to the blister container by heat bonding, solvent bonding, ultrasonic bonding, a thermoset adhesive, a solvent-based adhesive, an aqueous adhesive, or any combination thereof.

9. The system of claim 7, wherein the payload container releases the one or more payload substances in response to an external stimulus.

10. The system of claim 9, wherein the external stimulus is a change in isotropic pressure, a change in anisotropic pressure, a change in temperature, one or more chemical reagents, air, water, hydrocarbons, radiation, or any combination thereof.

11. The system of claim 10, wherein the payload container maintains containment of payload substances in excess of 125° C. and 0.5-30 kPSI.

12. The system of claim 10, wherein the stimulus is a temperature in excess of 175° C.

13. The system of claim 10, wherein the external stimulus compromises the lidding material of the payload container for the release or exposure of the one or more payload substances.

14. The system of claim 10, wherein the external stimulus compromises the blister container of the payload container for the release or exposure of the one or more payload substances.

15. The system of claim 10, wherein the external stimulus compromises the adhesive of the payload container for the release or exposure of the one or more payload substances.

16. The system of claim 7, wherein the blister container of the payload container is made from a thermoplastic material.

17. The system of claim 16, wherein the thermoplastic material is any one of a polystyrene, a polyvinyl chloride, a polyethylene terephthalate glycol, a polyethylene, and a polypropylene, a polyacrylate, a poly(methyl methacrylate), a polyester, a polylactic acid, and a polyglycolic acid.

18. The system of claim 7, wherein an external surface of the blister container is textured.

19. The system of claim 7, wherein an external surface of the blister container is functionalized with a hydrophobic chemical species, a hydrophilic chemical species, an amphiphilic chemical species, a zwitterionic chemical species, or any combination thereof.

20. The system of claim 7, wherein the blister container of the payload container comprises two or more subcavities separated by a barrier, each subcavity containing one or more payload substances.

21. The system of claim 7, wherein the lidding material of the payload container is any one of a metal foil, a polymeric material, a resin, a woven material, a non-woven material, or any combination thereof.

22. The system of claim 21, wherein the lidding material of the payload container is a pre-formed sheet or a coating material.

23. The system of claim 7, wherein the each payload container has an aspect ratio ranging from about 1 to about 10.

24. The system of claim 7, wherein the lidding material is bonded to the blister sheet by heat bonding, solvent bonding, ultrasonic bonding, a thermoset adhesive, a solvent-based adhesive, an aqueous adhesive, or any combination thereof.

* * * * *